US007059678B1

(12) United States Patent
Taylor

(10) Patent No.: US 7,059,678 B1
(45) Date of Patent: Jun. 13, 2006

(54) PORTABLE ORTHOPEDIC SUPPORT DEVICE

(76) Inventor: Alan R. Taylor, 3903 N. Rye Rd., Parrish, FL (US) 34219

( * ) Notice: Subject to any disclaimer, the term of this patent is extended or adjusted under 35 U.S.C. 154(b) by 0 days.

(21) Appl. No.: 10/354,309

(22) Filed: Jan. 30, 2003

(51) Int. Cl.
*A47C 4/54* (2006.01)

(52) U.S. Cl. ..... 297/284.6; 297/284.4; 297/452.41; 297/DIG. 3; 5/655.3; 5/454

(58) Field of Classification Search ..... 5/655, 5/710, 454, 713; 297/284.6, 284.4, 452.41, 297/DIG. 3, 284.3, 284.5, 219.1, 229, 228; 224/660, 662, 240, 241, 236, 235
See application file for complete search history.

(56) References Cited

U.S. PATENT DOCUMENTS

| | | | | | |
|---|---|---|---|---|---|
| 4,078,842 | A | | 3/1978 | Zur | |
| 4,190,286 | A | | 2/1980 | Bentley | |
| 4,518,200 | A | | 5/1985 | Armstrong | |
| 4,583,255 | A | | 4/1986 | Mogaki et al. | |
| 4,781,413 | A | | 11/1988 | Shumack, Jr. | |
| 4,893,367 | A | | 1/1990 | Heimreid et al. | |
| 5,314,235 | A | | 5/1994 | Johnson | |
| 5,320,409 | A | * | 6/1994 | Katoh et al. | 297/284.6 |
| 5,501,508 | A | * | 3/1996 | Llewellyn | 297/397 |
| 5,570,716 | A | | 11/1996 | Kamen et al. | |
| 5,641,199 | A | * | 6/1997 | Bond-Madsen | 297/229 |
| 5,662,384 | A | | 9/1997 | O'Neill et al. | |
| 5,713,631 | A | * | 2/1998 | O'Neill et al. | 297/284.6 |
| 5,713,841 | A | | 2/1998 | Graham | |
| 5,785,669 | A | | 7/1998 | Proctor et al. | |
| 5,836,900 | A | * | 11/1998 | Leventhal | 601/57 |
| 5,868,463 | A | * | 2/1999 | MacKenzie et al. | 297/228.12 |
| 5,979,975 | A | | 11/1999 | Hiraoka | |
| 6,095,894 | A | | 8/2000 | Stevens | |
| 6,203,105 | B1 | * | 3/2001 | Rhodes, Jr. | 297/284.6 |
| 6,357,066 | B1 | * | 3/2002 | Pierce | 5/710 |
| 6,626,491 | B1 | * | 9/2003 | Blome et al. | 297/229 |

* cited by examiner

*Primary Examiner*—Peter M. Cuomo
*Assistant Examiner*—Erika Garrett
(74) *Attorney, Agent, or Firm*—Charles J. Prescott

(57) ABSTRACT

A portable pneumatic orthopedic body support device for selectively supporting body and torso areas of a user being seated atop a chair or seat. The device includes individual inflatable independent body and torso supports or chambers for legs, lumbar, shoulder blade and neck areas. These supports are independently inflatable and loosely connected together in spaced relationship preferably held thusly by a flexible air conduit assembly or harness. The device, wheel fully deflated includes a waist strap and flexible panels to enclose the supports and air pump/selector valve carryable around the waist as a fanny pack. A combination air pump and selector valve is also provided for selective delivery of compressed air through the conduit assembly to each of the inflatable supports separately and independently for maximum comfort, shape and size.

8 Claims, 4 Drawing Sheets

10
10'
12
22
24
90
92
94
96
98

PORTABLE ORTHOPEDIC SUPPORT DEVICE

BACKGROUND OF THE INVENTION

1. Field of the Invention

This invention relates generally to portable seats and body support devices, and more particularly to an inflatable orthopedic support device having loosely spaced apart individual inflatable body support members for selectively supporting those body and torso areas when seated upon a chair or seat having an upright back.

2. Description of Related Art

A number of prior patented devices are known to disclose inventions intended to provide additional body and torso support for a person seated or lying atop on what might otherwise be an uncomfortable support. Included in these prior art disclosures are various devices for distributing pressurized air to inflatable chambers or bladders which afford additional comfort and body support to a user positioned thereatop. The following U.S. Pat. Nos. provide such a body of teaching:

U.S. Pat. No. 5,979,975 to Hiraoka

U.S. Pat. No. 4,078,842 to Zur

U.S. Pat. No. 4,190,286 to Bentley

U.S. Pat. No. 5,713,631 to O'Neill, et al.

U.S. Pat. No. 4,518,200 to Armstrong

U.S. Pat. No. 5,570,716 to Kamen, et al

U.S. Pat. No. 5,662,384 to O'Neill, et al.

U.S. Pat. No. 4,583,255 to Magako, et al.

U.S. Pat. No. 5,713,841 to Graham

U.S. Pat. No. 4,893,367 to Heimreid, et al.

U.S. Pat. No. 4,781,413 to Shumack, Jr.

U.S. Pat. No. 6,095,894 to Stevens

U.S. Pat. No. 5,314,235 to Johnson

U.S. Pat. No. 5,785,669 to Proctor, et al.

Specific attention is drawn to U.S. Pat. No. 5,979,975 invented by Hiraoka disclosing an inflatable portable seat cushion with slip cover and pouch that may be carried about the users waist when not in use. This device is uniquely adapted for comfort while sitting atop a stadium seat at a public sports event and the like.

An inflatable full length body support seat is disclosed in U.S. Pat. No. 4,078,842 to Zur which also teaches an inflatable kit for adapting a conventional vehicle seat into a full length fully adjustable body support. This kit includes inflatable bags attached together in mattress-like form and a slipcover fitted over the air bags and the conventional car seat when in use.

Bentley, in U.S. Pat. No. 4,190,286 also discloses an inflatable seat cushion and body support assembly attachable atop a conventional seat cushion and back and providing individual air inflatable chambers extending transversely across the seat back which are individually inflatable to suit the user.

In U.S. Pat. No. 5,713,631, O'Neill discloses a dynamic backrest support system having an H-shaped inflatable cell within a seat cushion and a back cushion having two sets of alternately inflatable laterally extending cells forming a spinal recess contourable to conform to the shape of a person's back.

A seat pad with an adjustable lumbar support invented by Armstrong in U.S. Pat. No. 4,518,200 discloses a portable seat pad having an inflatable back element. A lumbar support is positioned within the body support portion for added spinal support and comfort.

The present invention discloses a portable, inflatable orthopedic support device and air pump particularly useful in achieving comfort such as while seated in a typical commercial airline seat during flight. The device is easily deployable from a compact waist pack wherein the individual inflatable body supports are positioned against the leg areas; the lumbar area, the shoulder blade area and the neck of the user and individually inflatable by the air pump to achieve a high level of selected comfort, shape and size accommodation of each user.

BRIEF SUMMARY OF THE INVENTION

This invention is directed to a portable pneumatic orthopedic body support device for selectively supporting body and torso areas of a user being seated atop a chair or seat. The device includes individual inflatable independent body and torso supports or chambers for legs, lumbar, shoulder blade and neck areas. These supports are independently inflatable and loosely connected together in spaced relationship preferably held thusly by a flexible air conduit assembly or harness. The device, when fully deflated includes a waist strap and flexible panels to enclose the supports and air pump/selector valve carryable around the waist as a fanny pack. A combination air pump and selector valve is also provided for selective delivery of compressed air through the conduit assembly to each of the inflatable supports separately and independently for maximum comfort, shape and size.

It is therefore an object of this invention to provide a portable, inflatable orthopedic support device for use in achieving an increased level of customized comfort while seated atop a seat or chair with back.

Still another object of this invention is to provide an inflatable orthopedic device deployable from a waist carried fanny pack into individually and selectively inflated body and torso supports atop a commercial airline seat during flight for added comfort.

Yet another object of this invention is to provide a combination inflatable orthopedic support device and air pump, either manual or battery powered, with selector valve, for the selective pressurization of each of the body and torso supports to accommodate a broad array of user sizes, weights and shapes.

In accordance with these and other objects which will become apparent hereinafter, the instant invention will now be described with reference to the accompanying drawings.

BRIEF DESCRIPTION OF THE SEVERAL VIEWS OF THE DRAWING(S)

FIGS. 7A to 7E schematically show the stages of deflation and storage of the device from its deployed configuration into a collapsed and stored waist carryable fanny pack.

Figures 7A, 7B, 7C, 7D, 7E, 8:
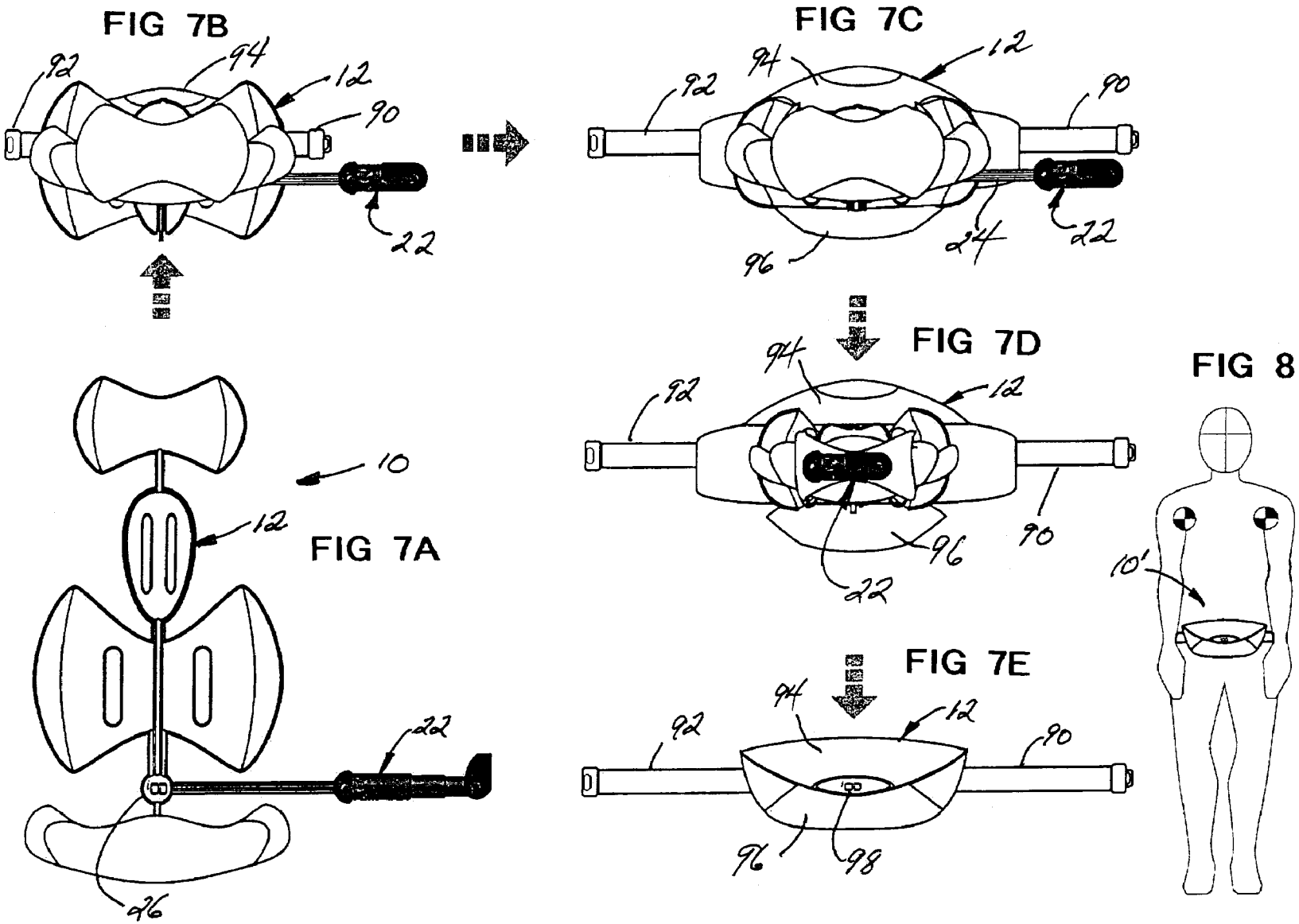

FIG. 8 is a simplified schematic view of the fully stored device of FIG. 7E carried around the waist of a user.

DETAILED DESCRIPTION OF THE INVENTION

Figure 1:
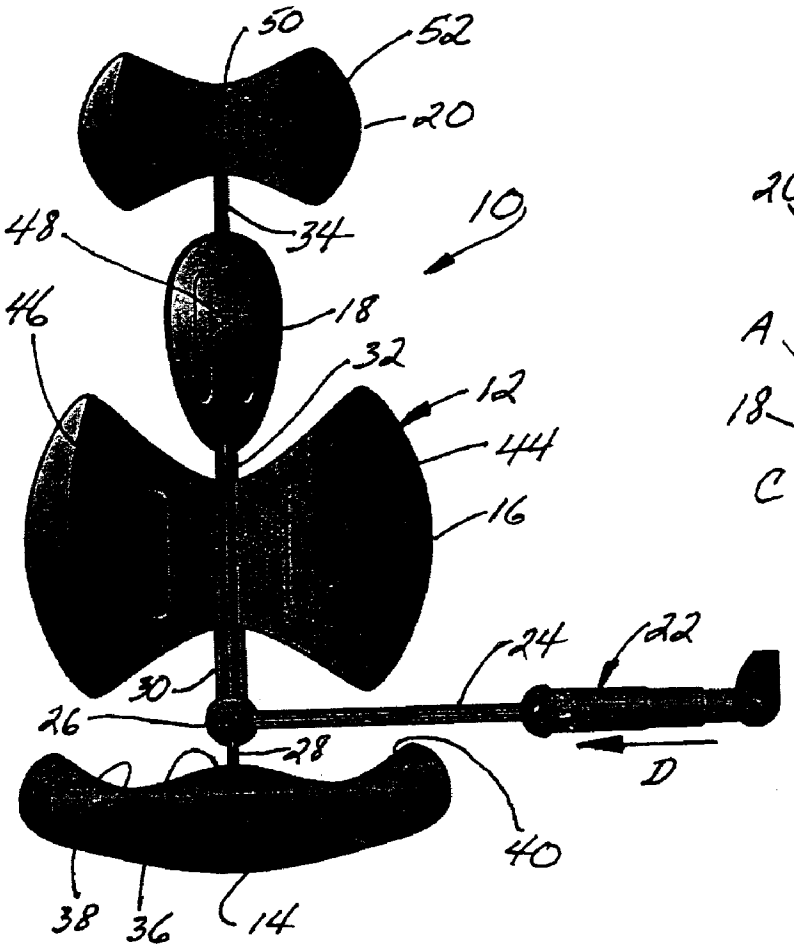
FIG. 1 is a front elevation view the invention including a manual pump and selector valve in its fully deployed, inflated configuration.
Figure 2:
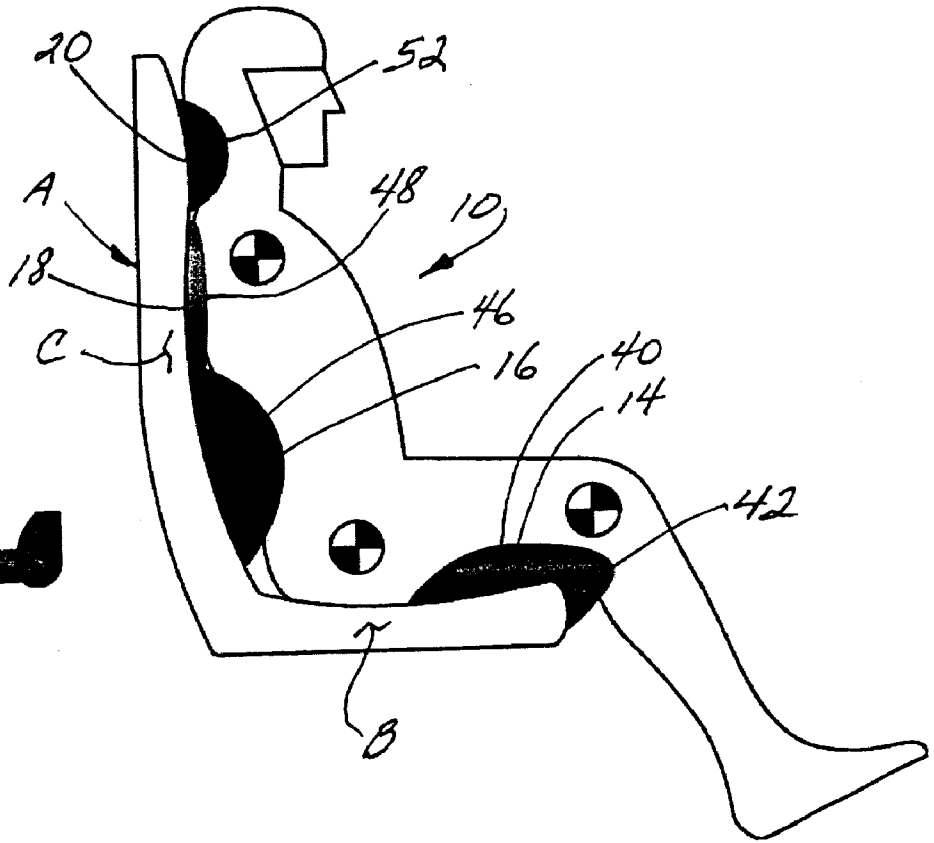
FIG. 2 is a side elevation schematic view of the invention of FIG. 1 positioned atop a conventional commercial airline seat in use.

Referring now to the drawings, the preferred embodiment of the invention is shown in FIGS. 1, 2 and 7A generally at numeral 10 in its fully deployed, inflated configuration. The device 10 includes a plurality of body and torso supports shown generally at 12 as an assembly, each of which are inflatable in bladder or air chamber fashion, and a manual air pump 22. These inflatable body and torso supports include an under-leg support 14, a lumbar support 16, a shoulder blade support 18 and a neck support 20.

The device 10 is shown schematically in use in FIG. 2 in a prime target market for this invention positioned atop a commercial airline passenger seat A which includes a narrow cushion or seat B and an upright seat back C. Such commercial airline seats A are notorious for being extremely hard and uncomfortable and relatively narrow in width so as to maximize on passenger carrying capacity of the aircraft.

The inflated leg support 14 is positionable atop the cushion B beneath the thighs and knees of the user and, as best seen in FIG. 1, includes a raised central portion 36 which, in combination with depressed areas or lowered areas 38 on either side thereof, serve to space the legs apart comfortably. Raised and enlarged side bolster areas 40 serve to prevent the legs from spreading apart excessively wherein the outer sides of the legs may come in contact with the hard surfaces of the armrest structure of these commercial airline seats A (not shown) or simply flop apart when the user is asleep.

The lower back or lumbar support 16 has a relatively thinner central section 44 and enlarged in length and thickness side or bolster portions 46. As best seen in FIG. 2, the enlarged side bolsters 46 partially surround the lower back and lumbar area of the user to add lateral stabilizing support and comfort in this most critical region of the lower torso.

The shoulder blade support 18 is substantially reduced in overall width to fit between the shoulder blades of the user along the upper spine area. Thus, the central support surface 48 is only slightly arcuate in convex form to add support to this region between the shoulder blades of the torso.

The neck support 20 is also thinner in both thickness and length in the central portion 50 while the outer bolster portions 52 are enlarged in both thickness and length so that, as best seen in FIG. 2, the neck and head of the user are laterally stabilized and supported from the relatively harsh padded headrest surface of the seat back C.

Figure 3:
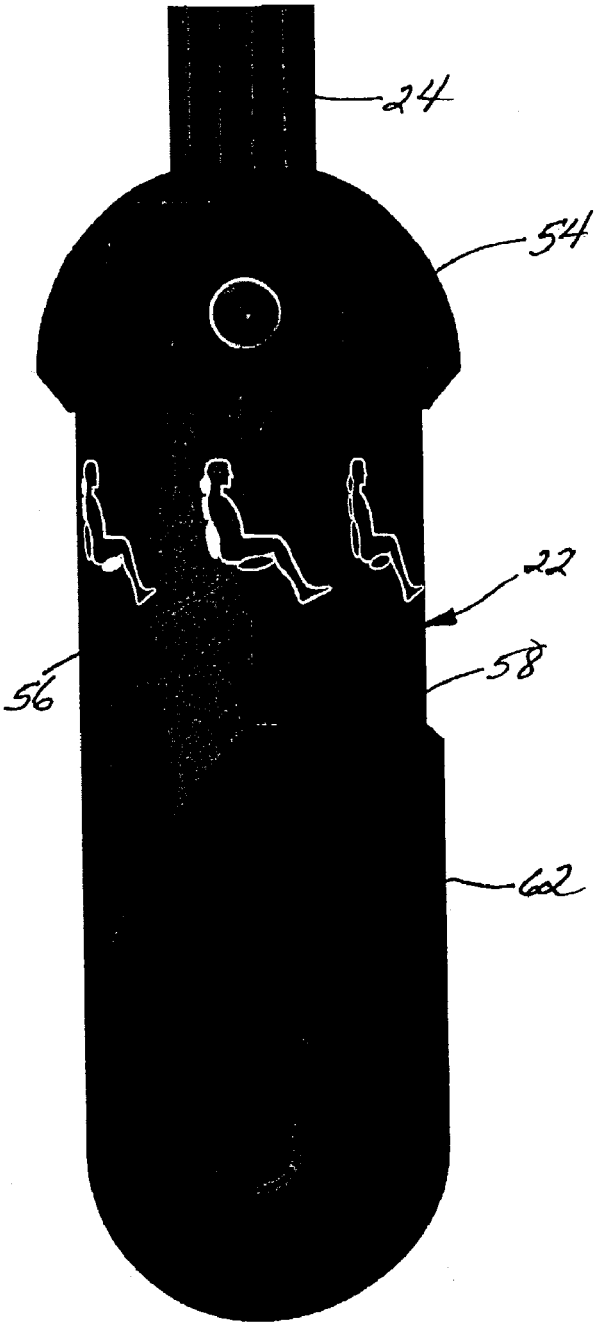
FIG. 3 is an enlarged view of a combination manual air pump and selector valve shown in FIG. 4 in the stored configuration.
Figure 4:
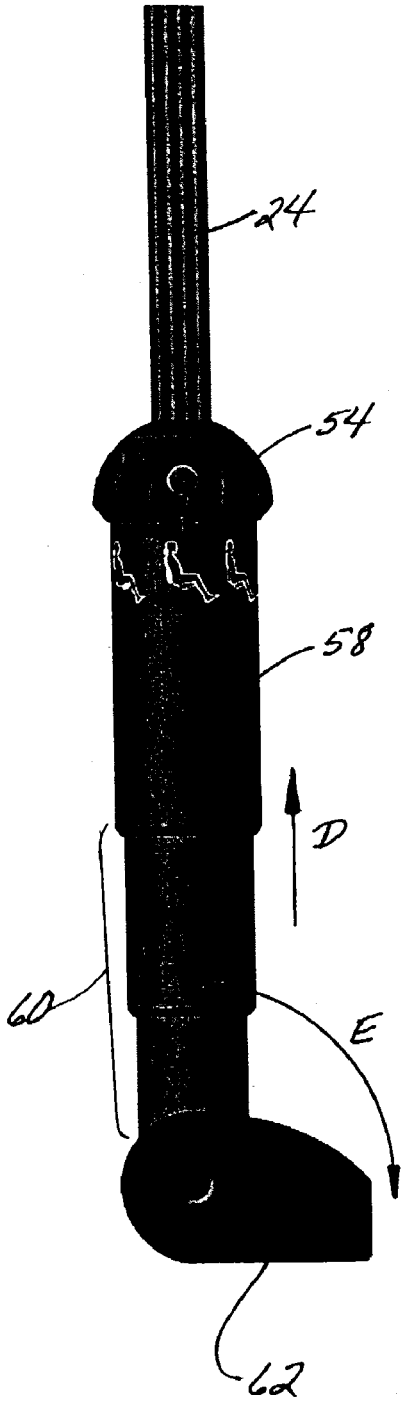
FIG. 4 is a side elevation view of the manual air pump in the deployed ready-to-use configuration.

Referring to FIGS. 1, 3 and 4, a combination manual pump and selector valve is there shown generally at numeral 22 which serves to manually inflate each of these air chambers or supports 14, 16, 18 and 20 after the device 10 has been unfolded in deflated form and positioned atop the cushion B and against the seat back C surfaces. By flipping the handle 62 open in the direction of arrow B in FIG. 4, the telescoping portions 60 of the air chamber 58 may then be moved back and forth in the direction of arrow D to create pressurized air within the elongated housing 58 for distribution through one of the four flexible air conduits contained within a conduit assembly or harness 24.

A selector valve 54 may be rotated in the direction of arrow F to align one of the indexed icons or indicia 56 displaying the particular inflatable support which will receive compressed air under pressure generated by the pump 22. Thus, compressed air may be selectively transferred via each of a plurality of ports (not shown) within selector valve 54 through each of the four air conduits of the air conduit assembly 24 through a manifold 26 to either the conduit 28 for inflating the leg support 14, conduit 30 for inflating the lumbar support 16, conduit 32 for inflating the shoulder blade support 18 or the conduit 34 for inflating the neck support 20, all of which are best seen in FIG. 1.

The conduit assembly 24 is preferably extruded elastomer hose formed of heat or chemically welded together flexible vinyl conduit to form a flexible harness which extends generally centrally along the buttocks and spine area of the user which also typically provides a natural channel upwardly extending to the neck support 20 without being noticeably felt by the user.

This conduit assembly 24 serves an additional purpose, that being the connecting together, in loosely positionable fashion, each of the inflatable supports 14, 16, 18 and 20 in the array shown in the Figures connected to the back surfaces of these supports 14, 16, 18 and 20. The user simply spaces each of these deflated or partially inflated supports against the seat cushion B and seat back C as desired, seats himself or herself thereupon and then begins to actuate the manual pump 22 as previously described. Selective inflation is, again, achieved using the selector valve 54. Note that inflation of each of these supports 14, 16, 18 and 20 allows the user to achieve a maximum level of comfort as the supports are independently inflated to accommodate the individual's body shape, size and weight at a desired level of comfort and support.

Each of the supports 14, 16, 18 and 20 are formed of modified vinyl sheets having a NYLON fabric outer surface which adds an increased level of friction to resist movement when positioned and inflated atop the seat cushion B and upright back C and also serves to prevent excess stretching of each of these supports to maintain the level of comfort initially achieved during selective pressurization of each inflatable support 14, 16, 18 and 20 as desired.

Figure 5:
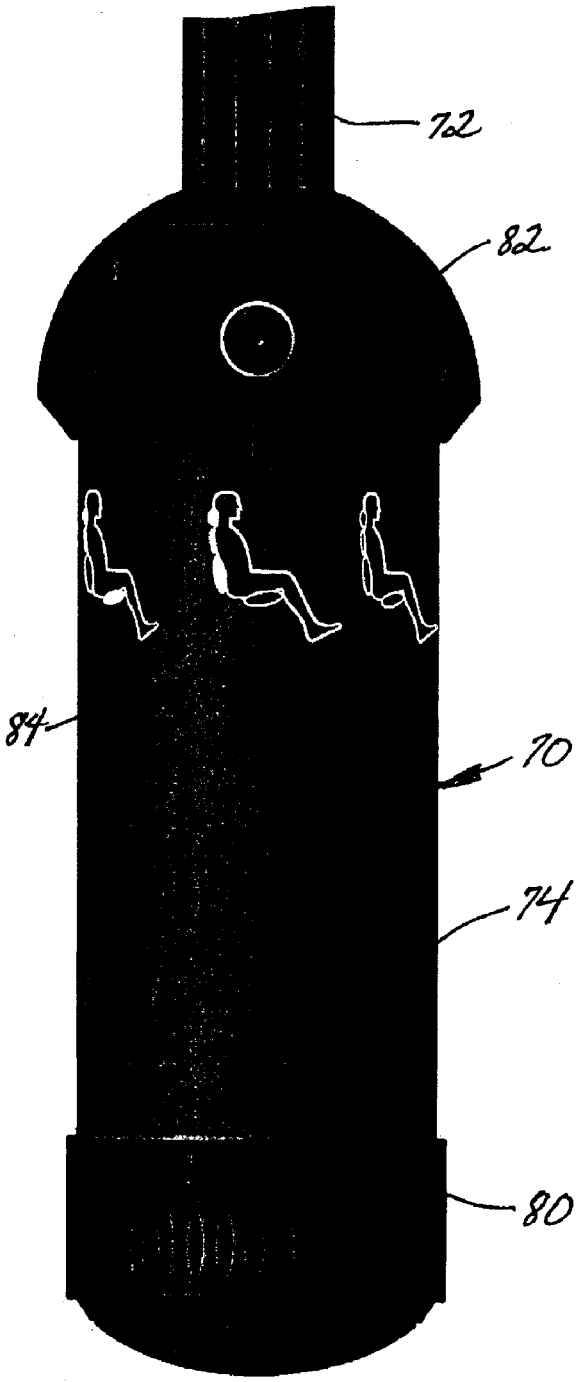
FIG. 5 is an enlarged view of a battery powered combination air pump and selector valve shown in FIG. 6.
Figure 6:
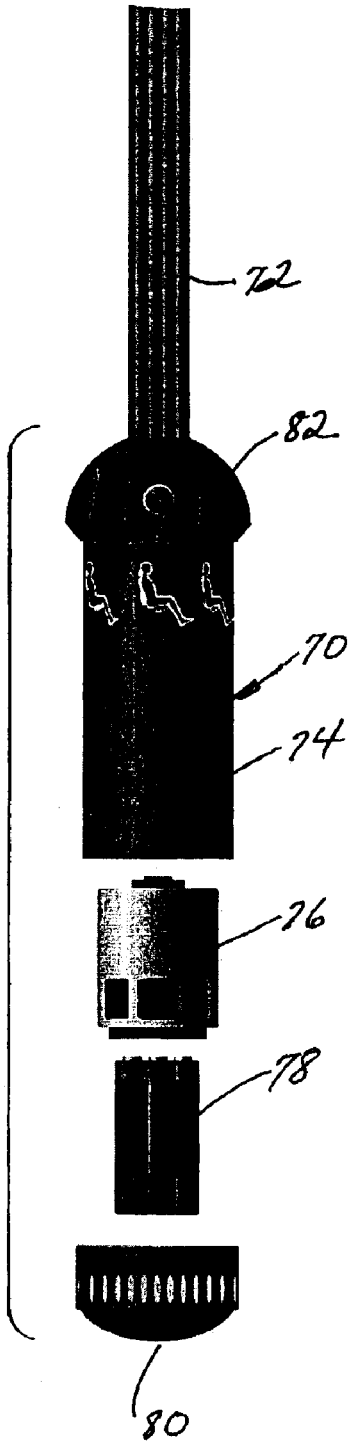
FIG. 6 is an exploded side elevation view of the battery powered air pump.

An electric pump arrangement is shown in FIGS. 5 and 6 generally at 70. This electric pump 70 and rotatable selector valve 82 combination includes an elongated air chamber 74 and a rotatable selector valve 82 which selectively conveys pressurized air to one of the flexible conduits within the conduit assembly 72 in a manner previously described. By alignment of a particular indexed icons or indicia 84 with the selector valve 82, the desired support 14, 16, 18 or 20 is then pressurized by actuation of the motorized pump 76 which is battery powered by batteries 78 and held in place by a vented cap 80 attached to the lower end of the elongated cylindrical housing 74.

Reverse deployment of the device is shown sequentially in FIGS. 7A to 7E. From the fully inflated configuration shown in 7A, the trapped air within each of the supports of the device 10 is released through the manual pump 22 initially into the substantially collapsed and deflated configuration shown in 7B. At this stage, storage flaps 94 and 96 are revealed which are attached to the back of the lumbar support 16. Extendable waistbands 90 and 92 are also revealed beginning as shown in FIG. 7B.

In FIG. 7C, the waist straps 90 and 92 are fully extended manually, and in FIG. 7D, the manual pump 22 and flexible conduit assembly 24 are positioned centrally against the deflated supports and the storage flaps 94 and 96 are partially wrapped therearound. In FIG. 7E, the storage flaps 94 and 96 have been fully wrapped around the deflated supports and are interengaged over a clip 98 to secure the stored "fanny pack" configuration. As seen in FIG. 8, the stored device shown at 10' is readily attachable around the waist of the user for carrying either against the stomach or against the lower back as desired.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A portable orthopedic support device for use in selectively supporting specific body and torso areas of a user while seated atop a chair or seat with an upright back comprising:

an inflatable leg support, lumbar support, shoulder blade support and neck support, each of which are independently and individually inflatable and loosely connected together in spaced apart independent relationship one to another;

said leg support dependently positionable atop the chair or seat for supporting the backs of the legs and knees of the user;

said lumbar support dependently positionable against the lower back area of the chair or seat for supporting the lower back area of the user, said shoulder blade support dependently positionable against the central back area of the chair or seat for supporting the central upper back area of the user, said neck support dependently positonable against the upper back area of the chair or seat for supporting the back of the neck area of the user;

opposing storage flaps attached to said lumbar support for being wrapped around and substantially enclosing said supports when deflated to form a carryable pack;

waistband members attached to and extendable laterally in either direction from said lumbar support adapted to attach said carrying pack around the waist area of the user.

2. A portable orthopedic support device as set forth in claim 1, wherein:

each of said supports is covered or encased with a modified vinyl having a NYLON fabric outer surface for enhanced surface friction to resist movement and substantially reducing excess stretching of said supports when inflated.

3. A portable pneumatic orthopedic support device which, after being positioned atop a chair or seat with an upright back, selectively supports body and torso areas of a user seated atop said device and the chair or seat, comprising:

a leg support, a lumbar support, a shoulder blade support and a neck support, all of which are independently and individually inflatable and loosely connected together in spaced apart independent relationship one to another;

said leg support dependently positionable atop the chair or seat for supporting the backs of the legs and knees of the user;

said lumbar support dependently positionable against the lower back area of the chair or seat for supporting the lower back area of the user;

said shoulder blade support dependently positionable against the central back area of the chair or seat for supporting the central upper back area of the user;

said neck support dependently positionable against the upper back area of the chair or seat for supporting the back of the neck area of the user;

a combination air pump and selector valve;

a flexible conduit assembly forming a flexible harness of attached together said air conduits, said harness extending and operably connected between said selector valve and each of said supports, said flexible harness extending generally centrally along the buttocks and spine area of the user and connecting said leg support, said lumbar support, said shoulder blade support and said neck support together to establish a spaced apart relationship between said supports and for selective, independent delivery of compressed air from said air pump to each of said supports whereby compressed air produced by said air pump may be selectively and individually directed to each of said supports to allow the user to maximize comfort level, shape and size of each of said supports.

4. A portable orthopedic support device as set forth in claim 3, wherein:

each of said supports is covered or encased with a modified vinyl having a NYLON fabric outer surface for enhanced surface friction to resist movement and substantially reducing excess stretching of said supports when inflated.

5. A portable orthopedic support device as set forth in claim 4, wherein:

said device, when fully deflated, includes means for storing and carrying thereof by a waist strap connectable around the waist of the user.

6. A portable orthopedic support device for use in selectively supporting body and torso areas of a user while seated atop a chair or seat with an upright back and being adjustable to the comfort, shape and size of each particular user comprising:

a plurality of inflatable body supports including a leg support, a lumbar support, a shoulder blade support and a neck support, all of which are independently and individually inflatable and loosely connected together in spaced apart relation one to another;

said leg support dependently positionable atop the chair or seat and having a raised central portion, depressed or lowered areas on either side of said central portion and raised and enlarged side bolster areas for supporting and spacing apart the backs of the legs and knees of the user;

said lumbar support dependently positionable against the lower back area of the chair or seat and having a relatively thinner central section and an enlarged in length and thickness side bolster portions which partially surround and laterally stabilize a lower back and lumbar area of the user;

said shoulder blade support dependently positionable against the central back area of the chair or seat and having a convex form and a width smaller than that of said leg and lower back support adapted to fit between the shoulder blades and extend along the upper spine area of the user for supporting the central upper back area of the user;

said neck support dependently positionable against the upper back area of the chair or seat having a central portion of relatively thinner thickness and length to that of outer bolster portions of said neck support for supporting and laterally stabilizing the back of the neck area of the user;

a combination air pump and selector valve positioned within a housing and operably connected to said leg support, said lumbar support, said shoulder blade support and said neck support whereby compressed air produced by said air pump may be selectively and individually directed to each of said supports thus allowing the user to maximize comfort level, shape and size of each of said supports.

7. A portable orthopedic support device as set forth in claim 6, wherein:

each of said supports is covered or encased with a modified vinyl having a NYLON outer surface for enhanced surface friction to resist movement and substantially reducing excess stretching of said supports when inflated.

8. A portable orthopedic support device as set forth in claim 7, wherein:

storage flaps attached to the back of one said support for wrapping and storing said device when deflated.

* * * * *